US011753284B2

(12) United States Patent
Roni-Damond et al.

(10) Patent No.: US 11,753,284 B2
(45) Date of Patent: Sep. 12, 2023

(54) LIFTING CRANE WITH A SYSTEM FOR AUTOMATED DETERMINATION OF THE REEVING

(71) Applicant: MANITOWOC CRANE GROUP FRANCE, Dardilly (FR)

(72) Inventors: Bruno Roni-Damond, Lyons (FR); François Lemire, Soucieu en Jarrest (FR); Olivier Gollion, Caluire et Cuire (FR)

(73) Assignee: MANITOWOC CRANE GROUP FRANCE, Dardilly (FR)

( * ) Notice: Subject to any disclaimer, the term of this patent is extended or adjusted under 35 U.S.C. 154(b) by 202 days.

(21) Appl. No.: 17/104,643

(22) Filed: Nov. 25, 2020

(65) Prior Publication Data

US 2021/0188599 A1 Jun. 24, 2021

(30) Foreign Application Priority Data

Nov. 29, 2019 (FR) ..... 19/13446

(51) Int. Cl.
*B66D 3/04* (2006.01)
*B66C 13/16* (2006.01)
*B66C 23/02* (2006.01)

(52) U.S. Cl.
CPC ..... *B66D 3/043* (2013.01); *B66C 13/16* (2013.01); *B66C 23/022* (2013.01)

(58) Field of Classification Search
CPC ..... B66D 3/043; B66C 13/16; B66C 23/26; B66C 23/022
See application file for complete search history.

(56) References Cited

U.S. PATENT DOCUMENTS 2,463,394 A * 3/1949 King ..... B66C 13/00 254/399
3,794,185 A * 2/1974 Kroll ..... B66D 3/043 212/105

(Continued)

FOREIGN PATENT DOCUMENTS

| | | |
|---|---|---|
| CN | 109879181 A | 6/2019 |
| FR | 3061163 A1 | 6/2018 |
| SU | 397470 A1 | 9/1973 |

OTHER PUBLICATIONS

English translation of CN 109879181 A, 2022, Espacenet.com (Year: 2022).*

(Continued)

*Primary Examiner* — Sang K Kim
*Assistant Examiner* — Nathaniel L Adams
(74) *Attorney, Agent, or Firm* — Cook Alex Ltd.

(57) ABSTRACT

A lifting crane having a jib and a lifting device with double reeving configured to distribute and lift a load along the jib, wherein the lifting device is reversibly configurable between two reeving configurations including a single reeving configuration with two lifting strands and a double reeving configuration with four lifting strands. The lifting device includes a reeving change system for performing a reeving change between the single reeving configuration and the double reeving configuration, and vice versa. The lifting crane further includes a system for automated determination of the reeving configured to automatically determine the reeving configuration between the single reeving configuration and the double reeving configuration.

15 Claims, 6 Drawing Sheets

(56) References Cited

U.S. PATENT DOCUMENTS 3,993,287 A * 11/1976 Andersson ..... B66D 3/043
212/102
6,926,103 B1 * 8/2005 Roodenburg ..... E21B 19/09
175/203

OTHER PUBLICATIONS

English translation of FR 3061163 A1, 2022, Espacenet.com (Year: 2022).*
FR search report and written opinion dated Aug. 4, 2020, issued in connection with corresponding FR Pat. Appl. No. 219/13446 (9 pages).

* cited by examiner

[Fig 1]
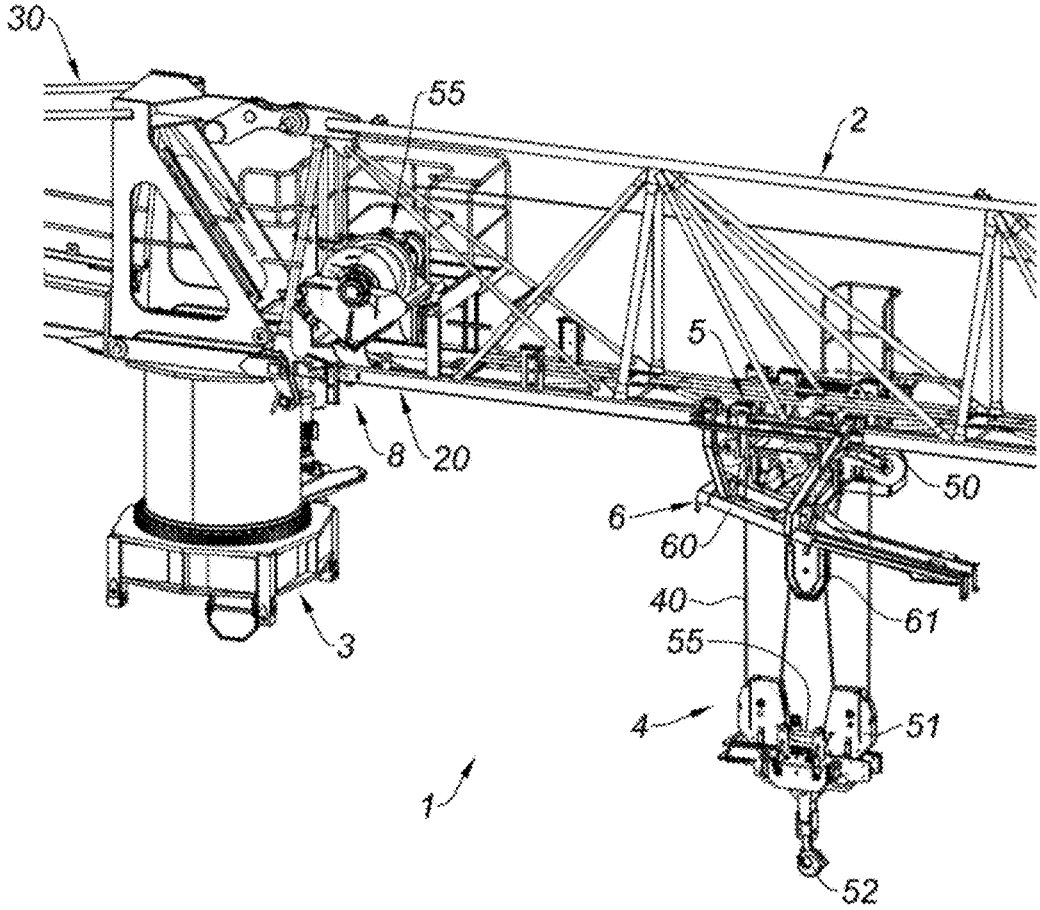

[Fig 2]
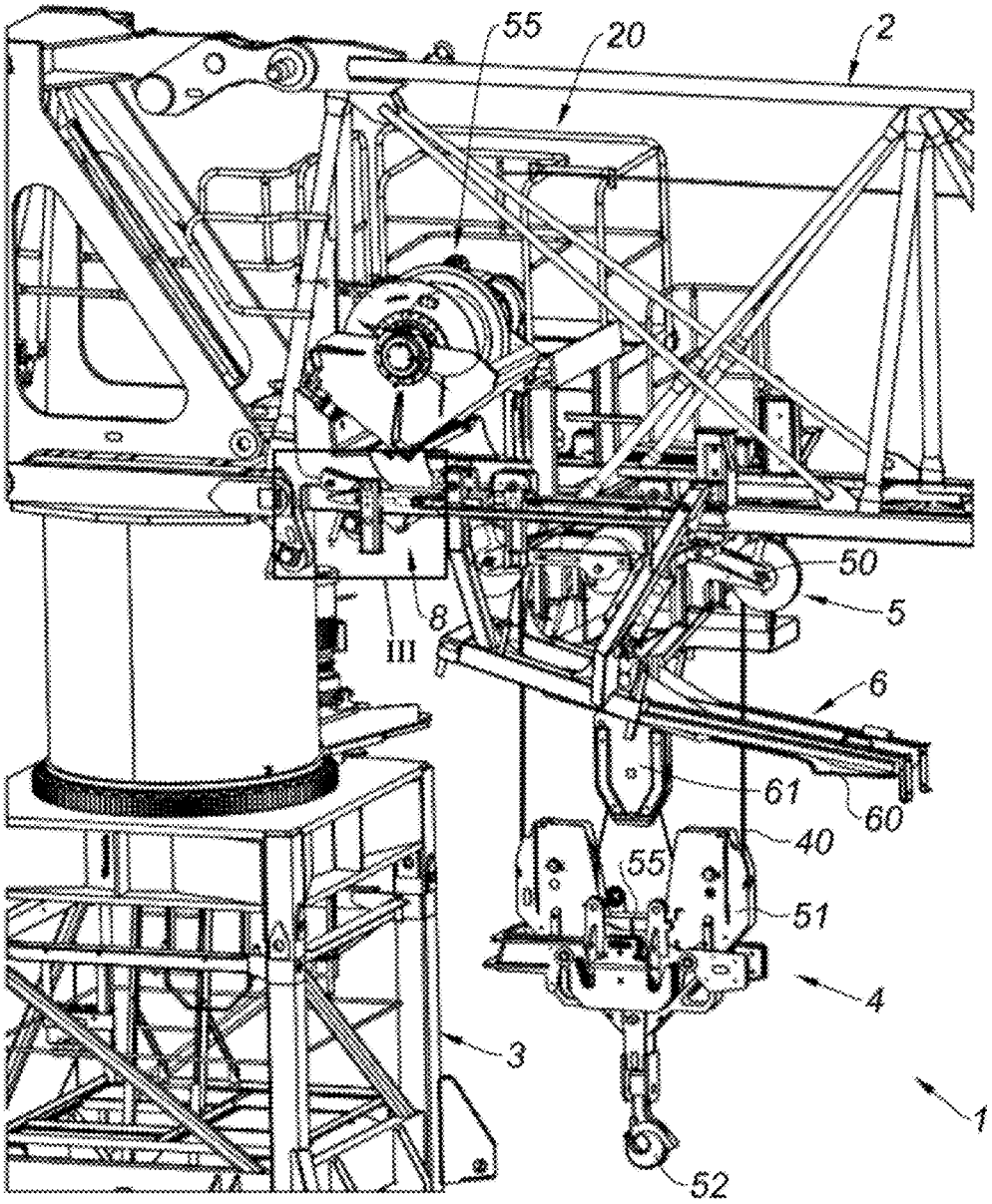

[Fig 3]
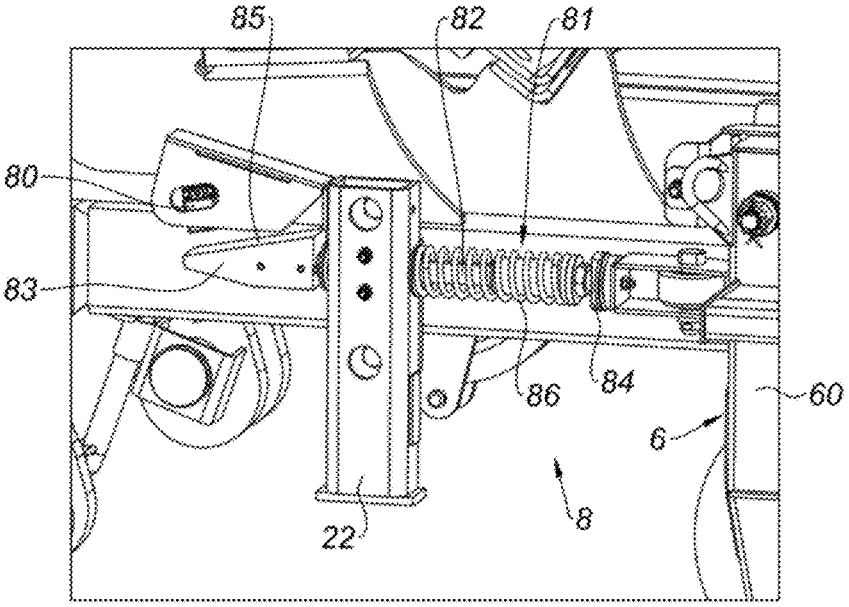

[Fig 4]
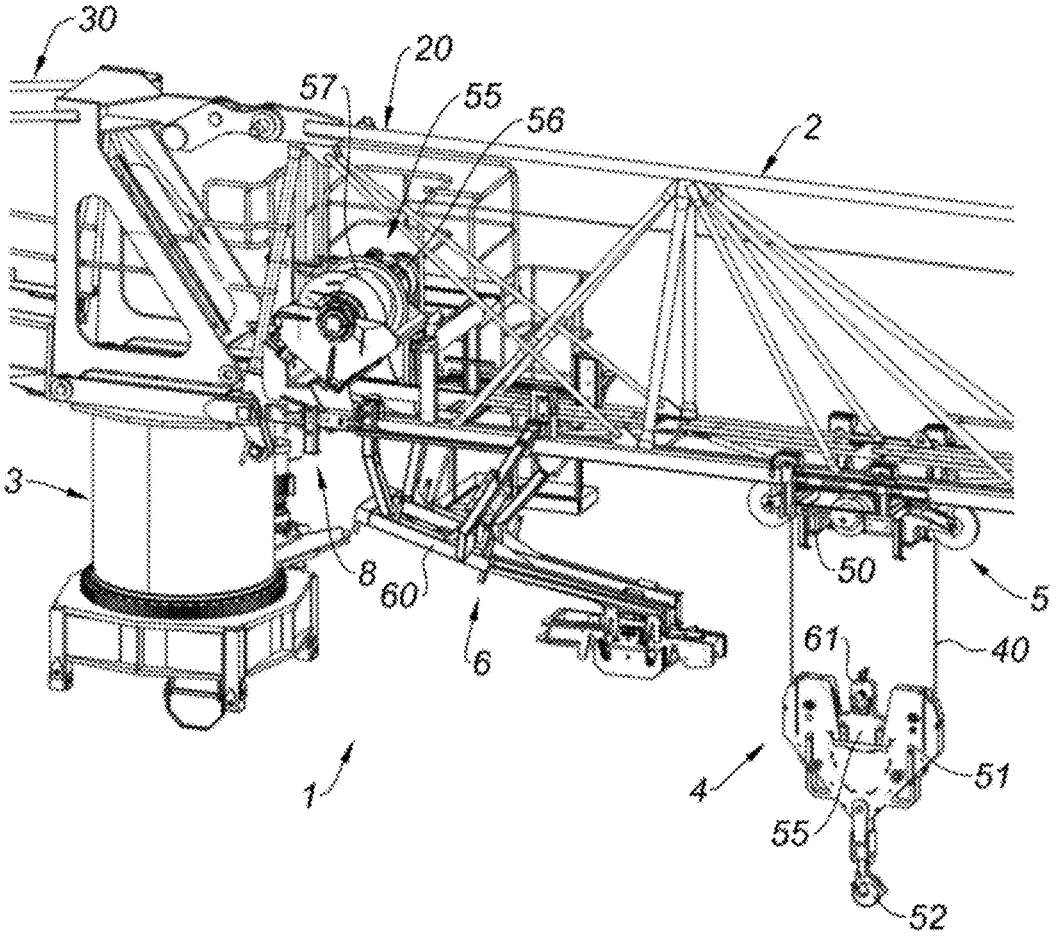

[Fig 5]
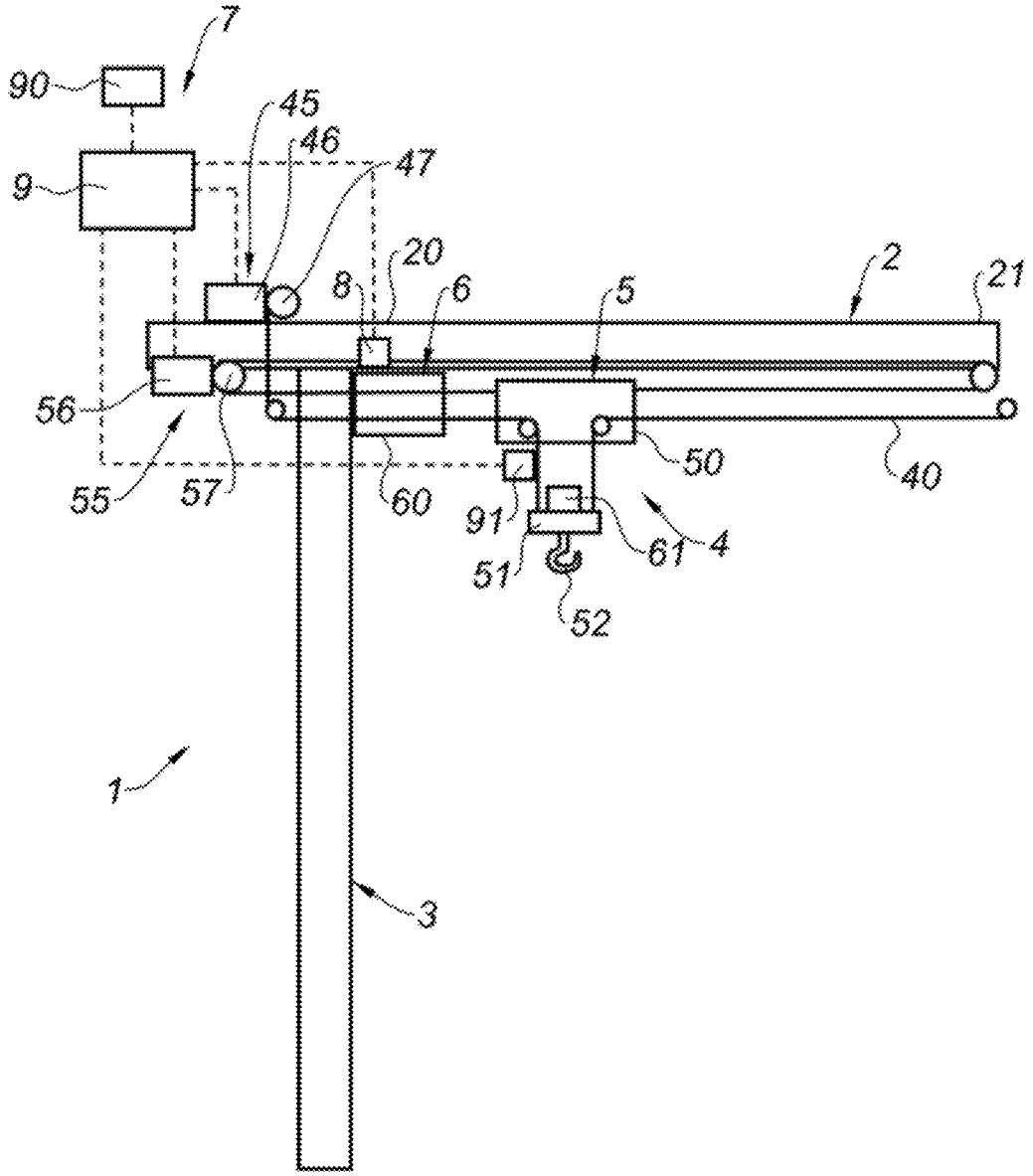

[Fig 6]
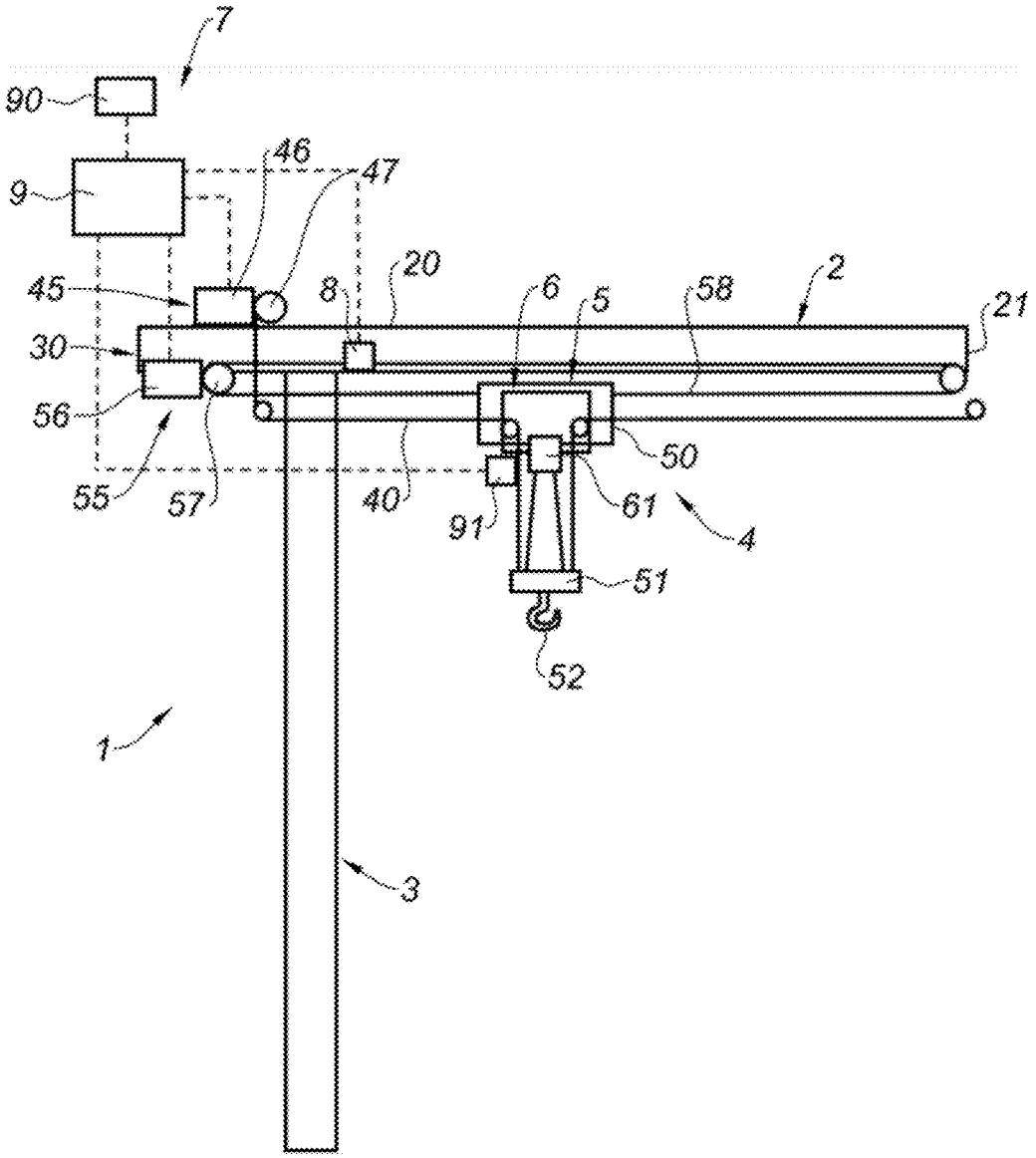

LIFTING CRANE WITH A SYSTEM FOR AUTOMATED DETERMINATION OF THE REEVING

FIELD

The invention relates to a lifting crane comprising a jib and a double reeving lifting device designed to distribute and lift a load along the jib.

It relates more particularly to a lifting crane wherein the lifting device is reversibly configurable between two reeving configurations including a single reeving configuration with two lifting strands and a double reeving configuration with four lifting strands, and wherein the lifting device comprising a reeving change system allowing a reeving change between the single reeving configuration and the double reeving configuration.

The invention finds a preferred, and non-limiting, application in the field of the tower cranes.

BACKGROUND

In a known manner, a lifting crane includes a monitoring/control unit monitoring all crane movements in order to guarantee a correct use within the authorized limits of the crane, and in particular to guarantee the stability of the crane by permanently monitoring that the load suspended on the lifting device at the reach measured on the jib is less than a maximum load authorized by a predefined load curve.

In a known manner with electromechanical monitoring/control units, this function of monitoring the suspended load is carried out by a moment bar calculation which allows directly measuring an elastic deformation of the jib under the suspended load moment, with numerous drawbacks including the cost of such monitoring/control units and the complexity of implementation.

It is also known to calculate the suspended load from an actual lifting tension measured on at least one lifting strand (strand of the lifting cable partially supporting the load), then this lifting tension is multiplied by the number of lifting strands in action, which is two in single reeving configuration and four in double reeving configuration.

Also, it is necessary for the monitoring/control unit to be aware of the number of lifting strands, in other words of the reeving configuration between the single reeving configuration and the double reeving configuration.

Currently, the reeving configuration is known from a declarative mode, that is to say that it is the crane pilot who declares, on an interface, the current reeving configuration. Consequently, the stability of the crane, and therefore compliance with safety conditions, will depend on the correct statement of the reeving configuration by the pilot; it being noted that a poor consideration of the number of involved strands can lead to accepting an overload of a factor of 2 compared to the maximum authorized load, with serious consequences such as for example a tilting of the crane.

SUMMARY

Thus, the invention proposes removing this declarative mode of the reeving configuration, and at the same time removing the aforementioned drawbacks associated to its implementation, mainly including the risks of false statements, erroneous statements or late statements.

To this end, the invention relates to a lifting crane comprising a jib and a lifting device with double reeving designed to distribute and lift a load along the jib, said lifting device being reversibly configurable between two reeving configurations including a single reeving configuration with two lifting strands and a double reeving configuration with four lifting strands, and the lifting device comprising a reeving change system allowing performing a reeving change between the single reeving configuration and the double reeving configuration, and vice versa, said lifting crane being remarkable in that it comprises a system for automated determination of the reeving designed to automatically determine the reeving configuration between the single reeving configuration and the double reeving configuration.

Thus, the invention is based on an automated mode of determining the reeving configuration, rather than on a declarative mode, which allows making the recognition of the reeving configuration more reliable and thus allows automatically changing the load curve (adaptation of the load curve depending on the number of lifting strands) without a decision by the crane operator, and by making sure to always have the correct load curve, in particular during the transition phases, throughout the reeving change.

The invention also allows making the recognition of the reeving configuration more reliable without using a moment bar calculation which, in addition to being expensive, is complicated to implement.

According to one feature, the lifting device comprises a distributing trolley comprising a structure suspended on the jib and connected to a distribution system capable of displacing the distributing trolley along the jib in a forward direction and a rearward direction which are opposite to each other, and a main block suspended from said suspended structure by a lifting cable;

the reeving change system comprises a secondary block and a locking/unlocking mechanism cooperating with the main block and the secondary block to pass from the single reeving configuration to the double reeving configuration or vice versa; and the system for automated determination of the reeving comprises at least:

- a system for detecting the presence of the secondary block capable of detecting a presence/absence of the secondary block at a predetermined reference location occupied by said secondary block in either of the reeving configurations, and
- a monitoring/control unit connected to the system for detecting the presence of the secondary block and designed to automatically determine the reeving configuration depending on the detection of the absence/presence of the secondary block at the reference location.

Thus, the automated determination of the reeving configuration is based on the detection of the absence/presence of the secondary block at a reference location, which has the advantage of having a reliable detection and thus an equally reliable reeving configuration determination.

According to one possibility, the system for automated determination of the reeving comprises a storage module connected to the monitoring/control unit for storing at least one last reeving configuration determined by the monitoring/control unit, and the monitoring/control unit is designed to automatically determine the reeving configuration also depending on said last reeving configuration stored in the storage module.

Thus, during a reeving change, the monitoring/control unit can determine the new reeving configuration and check whether this determination is consistent with the last reeving configuration stored in the memory. Also, the monitoring/control unit can check whether or not a reeving change has been successfully carried out, so as to be able to safely deduce the new reeving configuration and, once the new reeving configuration has been determined, the latter is stored in the storage module until the next reeving change.

According to another possibility:

in the single reeving configuration, the locking/unlocking mechanism unlocks the secondary block which remains positioned inside a block housing provided on the main block such that the lifting cable cooperates with the main block for a two-strand lifting, and in the double reeving configuration, the locking/unlocking mechanism locks the secondary block on the distributing trolley at a location above the main block such that the lifting cable cooperates with both the main block and the secondary block for a four-strand lifting.

In a first embodiment, the system for detecting the presence of the secondary block is configured to detect the presence/absence of the secondary block inside the block housing occupied by the secondary block in the single reeving configuration and/or at the location above the main block occupied by the secondary block in the double reeving configuration.

Thus in this first embodiment, the system for detecting the presence of the secondary block implements a direct detection of the presence/absence of the secondary block at a reference location; this reference location corresponding:

to the inside of the block housing (if the secondary block is inside the block housing then the lifting device is in single reeving configuration);

to the location above the main block (if the secondary block is suspended from the location above the main block then the lifting device is in double reeving configuration).

In a second embodiment, the reeving change system comprises a remaining trolley comprising a frame suspended on the jib and supporting the secondary block, wherein:

in the double reeving configuration, the locking/unlocking mechanism locks together the distributing trolley and the remaining trolley which are assembled and displaceable in association along the jib, and the secondary block is suspended on the remaining trolley at the location above the main block; and in the single reeving configuration, the locking/unlocking mechanism unlocks the remaining trolley, such that the distributing trolley and the remaining trolley are disassembled, the secondary block is housed inside the block housing provided on the main block and the distributing trolley is displaceable on its own while the remaining trolley is statically positioned with the secondary block at a storage location;

and the system for detecting the presence of the secondary block is configured to detect a presence/absence of the remaining trolley at the storage location.

Thus, in this second embodiment, the system for detecting the presence of the secondary block implements an indirect detection of the presence/absence of the secondary block at a reference location. Indeed, it is the remaining trolley which is detected as being present/absent at this storage location, in other words:

if the remaining trolley is present at the storage location, then necessarily the secondary block is inside the block housing and the lifting device is in the single reeving configuration;

if the remaining trolley is absent from the storage location, then necessarily the secondary block is suspended at the location above the main block and the lifting device is in the double reeving configuration.

According to one variant, this storage location is located at the foot of the jib.

In a particular embodiment, the reeving change system passes the lifting device from the single reeving configuration to the double reeving configuration, and vice versa, by displacing the distributing trolley with the main block thereof, and the monitoring/control unit is connected to the distribution system to drive the displacement of the distributing trolley according to:

a first automated sequence passing the lifting device from the single reeving configuration to the double reeving configuration; and vice versa a second automated sequence passing the lifting device from the double reeving configuration to the single reeving configuration;

depending on the reeving configuration which is automatically determined by said monitoring/control unit.

Thanks to the automated detection of the reeving configuration, it is therefore now advantageous to drive, in an automated manner, the reeving changes, integrally or not from start to finish; just as it is conceivable that this driving comes under steering assistance, for example by monitoring or limiting the speeds and/or the acceleration and/or the braking and/or the stops Advantageously, the monitoring/control unit is designed to enable:

the first automated sequence at least on condition that the monitoring/control unit has determined that the lifting device is in single reeving configuration;

the second automated sequence at least on condition that the monitoring/control unit has determined that the lifting device is in double reeving configuration.

Thus, the invention allows securing the reeving changes, and therefore avoiding erroneous operations.

In a particular embodiment, the lifting crane comprises a lifting winch provided with a lifting drum cooperating with the lifting cable to displace the load upward and downward, said lifting winch being equipped with an unwinding sensor capable of measuring an unwound length of the lifting cable, wherein the monitoring/control unit is designed to compare the unwound lengths of the lifting cable at the beginning of a first automated sequence and at the beginning of a second automated sequence which follows or precedes said first automated sequence.

According to one possibility, the monitoring/control unit is designed to automatically determine the reeving configuration also depending on the comparison between the unwound lengths of the lifting cable at the beginning of a first automated sequence and at the beginning of a second automated sequence which follows or precedes said first automated sequence.

Thus, this comparison allows making the determination of the reeving configuration even more reliable.

In an advantageous embodiment, a load sensor coupled to a lifting strand of the lifting cable for measuring a lifting tension on said lifting strand, wherein the monitoring/control unit is connected to the load sensor and is designed to calculate a value of the load depending on said lifting tension on said lifting strand and on the reeving configuration which is automatically determined by said monitoring/control unit.

The invention indeed finds an advantageous application for calculating a value of the load suspended from the lifting strands, reliably and without declarative mode, thus offering a reliable solution allowing overcoming human error and thus improving the safety level.

Alternatively, the monitoring/control unit is designed to compare the value of the load with a maximum authorized load.

The invention also relates to a driving method for driving a lifting crane according to the invention, as described above, comprising the steps of:

- performing a reeving change between the single reeving configuration and the double reeving configuration, or vice versa;
- automatically determining the reeving configuration between the single reeving configuration and the double reeving configuration.

According to one feature, the driving method comprises the steps of:

- detecting a presence/absence of the secondary block at a predetermined reference location occupied by said secondary block in either of the reeving configurations;
- automatically determining the reeving configuration depending on the detection of the absence/presence of the secondary block at the reference location.

Advantageously, the driving method comprises a step of storing at least one last automatically determined reeving configuration, and wherein the configuration of the lifting device is automatically determined also depending on said last stored reeving configuration.

According to another feature, the driving method comprises a step of driving the displacement of the distributing trolley according to:

- a first automated sequence passing the lifting device from the single reeving configuration to the double reeving configuration; and vice versa
- a second automated sequence passing the lifting device from the double reeving configuration to the single reeving configuration; depending on the automatically determined reeving configuration.

Advantageously, the driving method comprises the step of enabling:

- the first automated sequence at least on condition that it is automatically determined that the lifting device is in single reeving configuration;
- the second automated sequence at least on condition that it is automatically determined that the lifting device is in double reeving configuration.

In a particular embodiment, the driving method comprises the steps of:

- measuring an unwound length of the lifting cable, said lifting cable cooperating with a lifting drum of a lifting winch to displace the load upward and downward,
- comparing the unwound lengths of the lifting cable at the beginning of a first automated sequence and at the beginning of a second automated sequence which follows or precedes said first automated sequence.

According to one possibility, the configuration of the lifting device is automatically determined also depending on the comparison between the unwound lengths of the lifting cable at the beginning of a first automated sequence and at the beginning of a second automated sequence which follows or precedes said first automated sequence.

According to another possibility, the driving method comprises the steps of:

- measuring a lifting tension on a strand of the lifting cable;
- calculating a value of the load depending on said lifting tension on said strand of the lifting cable and on the automatically determined reeving configuration.

Advantageously, the driving method comprises the step of comparing the value of the load with a maximum authorized load.

BRIEF DESCRIPTION OF THE DRAWINGS

Other features and advantages of the present invention will appear on reading the detailed description below, of a non-limiting example of implementation, made with reference to the appended figures wherein:

FIG. 1 is a perspective view of portion of a lifting crane in accordance with the invention, comprising a lifting device illustrated in the double reeving configuration, this lifting device comprising a distributing trolley and a remaining trolley which are assembled to each other, and a lifting cable cooperating with a main block and with a secondary block suspended above the main block;

FIG. 2 is a perspective view of portion of the lifting crane of FIG. 1, with the lifting device in the double reeving configuration and at the foot of the jib;

FIG. 3 is a zoomed view of zone III of FIG. 2 which is positioned on a system for detecting the presence of the secondary block;

FIG. 4 is a view of portion of the lifting crane of FIG. 1, with the lifting device in the single reeving configuration, where the distributing trolley and the remaining trolley are disassembled, the secondary block is housed in a block housing of the main block, and the remaining trolley being parked at the foot of the jib;

FIG. 5 is a schematic view of a lifting crane according to the invention in the single reeving configuration; and FIG. 6 is a schematic view of a lifting crane similar to that of FIG. 5 but in the double reeving configuration.

DESCRIPTION

With reference to the Figures, a lifting crane 1 according to the invention, of the tower crane type, comprises a distributing jib 2 mounted on a tower 3 (also called a mast) at the foot 20 of the jib 2. Conventionally, the foot 20 of the jib 2 is rotatably mounted on the tower 3 along a vertical axis. The jib 2 can be extended to the other side of tower 3 by a counter-jib 30, generally provided with ballasts.

The lifting crane 1 further includes a lifting device 4 with double reeving designed to distribute a load (not illustrated) along the jib 2, this lifting device 4 circulating on a rolling path formed on the jib 2, between the foot 20 and the tip 21 of the jib 2, also called the free end of the jib 2.

This lifting device 4 comprises a distributing trolley 5 which includes a structure 50 suspended on the rolling path by front and rear primary rolling members formed of rollers or wheels rolling on the rolling path. This suspended structure 50 supports pulleys which ensure the guiding of a lifting cable 40.

The suspended structure 50 is connected to a distribution system 55 capable of displacing the distributing trolley 5 along the rolling path in a forward direction (in other words in the direction of the tip 21 of jib 2, to the right in the Figures) and an opposite rear direction (in other words in the direction of the foot 20 of the jib 2, to the left in the Figures).

As schematized in FIGS. 4, 5 and 6, this distribution system 55 comprises a motor 56 driving a distribution winch 57 coupled to a distribution cable 58 having strands fastened to either side of the distributing trolley 5 and which circulates to a tip 21 of jib 2.

The distributing trolley 5 further comprises a main block 51 suspended from the suspended structure 50 by the lifting cable 40. This main block 51 supports a lifting member 52, in the lower portion; this lifting member 52 being provided for hooking the load and could be in the form of a hook hinged on the main block 51.

This lifting device 4 is reversibly configurable between two reeving configurations including:

- as illustrated in FIGS. 4 and 5, a single reeving configuration with two lifting strands of the lifting cable 40; and
- as illustrated in FIGS. 1, 2 and 6, a double reeving configuration with four lifting strands of the lifting cable 40.

The lifting device 4 comprises a reeving change system allowing reversibly performing a reeving change between the single reeving configuration and the double reeving configuration, and vice versa.

This reeving change system comprises a remaining trolley 6 which is movable on the rolling path. The remaining trolley 6 comprises a frame 60 suspended on the rolling path by front and rear secondary rolling members formed of rollers or wheels rolling on the rolling path. The suspended frame 40 is open on the front, enabling an entry/exit of the distributing trolley 3.

This reeving change system also comprises a secondary block 61 supported by the suspended frame 60 of the remaining trolley 6 in the double reeving configuration.

This reeving change system also comprises a locking/unlocking mechanism cooperating with the main block 51 and the secondary block 61 to pass from the single reeving configuration to the double reeving configuration or vice versa, so that:

- in the double reeving configuration which is illustrated in FIGS. 1, 2 and 6, the locking/unlocking mechanism locks together the distributing trolley 5 and the remaining trolley 6 which are assembled and displaceable in association along the jib 2, and thus the locking/unlocking mechanism locks the secondary block 51 on the distributing trolley 5 which is then displaceable with the main block 51 and with the secondary block 61 which is suspended above the main block 51, such that the lifting cable 40 cooperates both with the main block 51 and the secondary block 61 for a four-strand lifting; and
- in the single reeving configuration which is illustrated in FIGS. 4 and 5, the locking/unlocking mechanism unlocks the remaining trolley 6 vis-à-vis the distributing trolley 5, such that the distributing trolley 5 and the remaining trolley 6 are disassembled and the distributing trolley 5 is displaceable on its own while the remaining trolley 5 is statically positioned at a stationary storage location under the jib 2, and more precisely under the foot 20 of the jib 2, and thus the locking/unlocking mechanism unlocks the secondary block 51 which remains positioned within a block housing 55 provided on the main block 51, such that the lifting cable 40 cooperates with the main block 51 for a two-strand lifting.

In the embodiment which is illustrated in FIGS. 1 to 4, the locking/unlocking mechanism comprises support members secured to the suspended frame 60 of the remaining trolley 6 and on which the secondary block 61 is suspended at a location above of the main block in the double reeving configuration, and the main block 51 comprises the block housing 55 arranged to at least partially house the secondary block 61 in the single reeving configuration.

Moreover, the lifting device 4 is arranged to pass from the single reeving configuration to the double reeving configuration, and vice versa, by displacing the distributing trolley 5 with the main block 51 thereof, and to do this the reeving change system and more specifically, the locking/unlocking mechanism thereof are designed to pass from the single reeving configuration to the double reeving configuration, and vice versa, by acting on the distribution system (in order to displace the distributing trolley 5) and on the lifting cable 40.

As schematized in FIGS. 5 and 6, the lifting crane 1 comprises a lifting system 45 provided with a motor 46 driving a lifting winch 47 provided with a lifting drum coupled to the lifting cable 40 on which the main bock 51 is suspended, and which circulates to the tip 21 of the jib 2.

This type of lifting device 4 is described, in full and detailed manner, in the French patent applications No. FR 3 061 163 and No. FR 3 061 164, and those skilled in the art will usefully refer to these two French patent applications for further structural and functional details, and a summary of the reeving changes is proposed below; it being noted that the invention is not limited to this type of lifting device 4.

The lifting device 4 passes from the double reeving configuration to the single reeving configuration as follows:

- in the double reeving configuration, the suspended structure 50 of the distributing trolley 5 is disposed at least partially inside the suspended frame 60 of the remaining trolley 6, and the secondary block 61 is carried by the support members of the suspended frame 60 of the remaining trolley 6, such that the secondary block 61 is locked on the distributing trolley 5 at a location above the main block 51;
- the main block 51 is raised until the secondary block 61 is unhooked from the support members after being pushed upwards by the main block 51, and until the secondary block 61 is at least partially housed inside the block housing 55 of the main block 51;
- the distributing trolley 5 is displaced in translation in the forward direction, the remaining trolley 6 not being displaced in translation and remaining at the predefined storage location under the jib 2, and this remaining trolley 6 having the suspended frame 60 thereof open on the front to allow a free passage for the lifting cable 40 which follows the distributing trolley 5; and
- the main block 51 is lowered and the lifting cable 40 cooperates with the main block 51 for a simple reeving work, the secondary block 61 being housed at least partially inside the block housing 55 of the main block 51.

The lifting device 4 passes from the single reeving configuration to the double reeving configuration as follows:

- in the single reeving configuration, the secondary block 61 is housed at least partially inside the block housing 55 of the main block 51;
- the main block 51 is raised until it makes contact with the suspended frame 60 of the remaining trolley 6;
- the distributing trolley 5 is displaced in translation in the rearward direction;
- the main block 51 is lowered until the secondary block 61 is hooked to the support members, enabling the main block 51 to lower without the secondary block 61 being housed inside the block housing 55 of the main block 51.

With reference to FIGS. 5 and 6, and according to the invention, the lifting crane 1 further comprises a system for automated determination of the reeving 7 designed to automatically determine the reeving configuration between the single reeving configuration and the double reeving configuration.

This system for automated determination of the reeving 7 comprises at least:

- a presence detection system 8 for detecting the presence of the secondary block 61 capable of detecting a presence/absence of the secondary block 61 at a predetermined reference location occupied by said secondary block 61 in either of the reeving configurations, and
- a monitoring/control unit 9 connected to the presence detection system 8 for detecting the presence of the secondary block 61 and designed to automatically determine the reeving configuration depending on the detection of the absence/presence of the secondary block 61 at the reference location.

This presence detection system 8 may comprise first means for detecting the presence/absence of the secondary block 61 inside the block housing 55 occupied by the secondary block 61 in the single reeving configuration. Thus, if the secondary block 61 is inside the block housing 55 then the lifting device 4 is in the single reeving configuration, and conversely if the secondary block 61 is absent from the block housing 55 then the lifting device 4 is in the double reeving configuration. This first means may for example comprise a contact sensor, a mechanical sensor, an electrical sensor, an optical sensor, etc., for example disposed in front of or inside the block housing 55.

This presence detection system 8 can comprise second means for detecting the presence/absence of the secondary block 61 at the location above the main block 51 occupied by the secondary block 61 in the double reeving configuration, and in particular the presence/absence of the secondary block 61 in suspension on the support members provided on the remaining trolley 6. Thus, if the secondary block 61 is present on the support members then the lifting device 4 is in the double reeving configuration, and conversely, if the secondary block 61 is absent from the support members then the lifting device 4 is in the single reeving configuration. This second means can for example comprise a contact sensor, a mechanical sensor, an electrical sensor, an optical sensor, etc. disposed for example in front of or on the support members.

This presence detection system 8 can comprise third means for detecting the presence/absence of the remaining trolley 6 at the storage location (under the foot 20 of the jib 2 in the illustrated embodiment), insofar as the presence/absence of the remaining trolley 6 at the storage location is correlated with the localization of the secondary block 61 and with the reeving configuration. Thus, if the remaining trolley 6 is present at the storage location then the lifting device 4 is in the single reeving configuration, and conversely if the remaining trolley 6 is absent from the storage location then the lifting device 4 is in the double reeving configuration.

This presence detection system 8 can comprise all or part of the first means, of the second means and of the third means described above.

In the illustrated embodiment, the presence detection system 8 comprises the third means, shown in FIG. 3, which comprises a proximity sensor 80 associated with a stop 81 mounted to slide in translation on a fixed structural element 22 of the lifting crane 1 placed at the foot 20 of the jib 2, such that the stop 81 is located in front of the remaining trolley 6 when the latter is at the storage location, under the foot 20 of the jib 2.

This stop 81 comprises a rod 82 extended by an enlarged head 83. The rod 82 is slidably mounted on the structural element 22 and, as such, the rod 82 passes through this structural element 22 into an orifice or bearing.

The rod 82 has a free front end provided with a stop surface 84 provided so that the remaining trolley 6 abuts against said stop surface 84. As such, the remaining trolley 6 may have, on the rear, a rear stopper 63 capable of bearing on the stop surface 84.

This stop surface 84 is enlarged relative to the rod 82, and is in particular in the form of a disc of a diameter which is greater than the diameter of the rod 82 if the latter is cylindrical.

The rod 82 has a rear end, opposite to the front end and therefore to the stop surface 84, on which the enlarged head 83 is fastened. Thus, the stop 81 has on either side of the structural element 22:

- a first end having the stop surface 84 and
- a second end having the enlarged head 83.

The enlarged head 83 has a detection surface 85 which is flat and inclined relative to a sliding direction of the stop 81 on the structural element 22.

There is also provided an elastic return member 86 interposed between the structural element 22 and the stop surface 84, wherein this return member 86 is in the form of a helical compression spring mounted around the rod 82.

The proximity sensor 80 is in turn fixedly mounted on the jib 2 and is disposed opposite to the detection surface 85 of the enlarged head 83 of the stop 81, wherein the proximity sensor 80 is configured to detect and measure the distance between said proximity sensor 80 and said detection surface 85. This proximity sensor 80 can for example be an inductive sensor or a light sensor (infrared sensor, etc.).

The stop 81 is selectively displaceable between:

- a rest position in the absence of thrust force exerted by the remaining trolley 6 on the stop 81, in other words in the absence of a thrust force exerted rearwardly (in other words in the direction of the jib foot) by the rear stopper 63 of the remaining trolley 6 on the stop surface 84 of the stop 81, it being noted that the return member 86 biases this stop 81 towards its rest position; and
- at least one detection position in the presence of a thrust force exerted by the remaining trolley 6 on the stop 81, in other words in the presence of a thrust force exerted rearwardly by the rear stopper 63 of the remaining trolley 6 on the stop surface 84 of the stop 81, it being noted that the return member 86 offers a force resistant to this thrust force exerted by the remaining trolley 6 on the stop 81.

In the detection position, the stop 81 has slid (rearwardly), compared to the rest position, which contributes to a modification of the distance between the proximity sensor 80 and the detection surface 85, and also to a compression of the return member 86 between the structural element 22 and the stop surface 84. It should be noted that the detection surface 85 is inclined in the direction of a reduction in the distance between the proximity sensor 80 and the detection surface 85 when the stop 81 has slid (rearwardly) from its rest position to the detection position.

As the proximity sensor 80 is configured to detect and measure the distance between the proximity sensor 80 and the detection surface 85, this proximity sensor 80 is then configured to detect the stop 81 in its rest position and in its detection position, wherein:

- the rest position corresponds to a double reeving configuration, the remaining trolley 6 being in displacement with the distributing trolley 5 and therefore absent from the storage location at the foot 20 of the jib 2; and the detection position corresponds to a single reeving configuration, the remaining trolley 6 being present at the storage location at the foot 20 of the jib 2.

Thus, the monitoring/control unit 9 allows automatically determining the reeving configuration depending on the detection operated by the presence detection system 8.

Advantageously, the system for automated determination of the reeving 7 comprises a storage module 90 (or memory) connected to the monitoring/control unit 9 to store at least one last reeving configuration determined by the monitoring/control unit. 9. In other words, the last reeving configuration is stored in this storage module 90, such that when a reeving change is operated, the monitoring/control unit 9 is designed to automatically determine the reeving configuration also depending on this last reeving configuration which is stored in the storage module.

Once the new reeving configuration has been determined, based on the at least one detection made by the presence detection system 8 and the last stored reeving configuration, it is this new reeving configuration which is stored in the storage module 90 and which therefore becomes the last reeving configuration. In other words, the reeving configuration is updated in the storage module 90 at each reeving change.

As schematized in FIGS. 5 and 6, this monitoring/control unit 9 can be connected to the distribution system 55 and also to the lifting system 45 to drive the displacement of the distributing trolley 5 and the displacement of the lifting cable 40 (and therefore of the main block 51) according to:

- a first automated sequence passing the lifting device 4 from the single reeving configuration to the double reeving configuration; and vice versa
- a second automated sequence passing the lifting device 4 from the double reeving configuration to the single reeving configuration;

depending on the reeving configuration which is automatically determined by this monitoring/control unit 9.

Also, the monitoring/control unit 9 can enable:

- the first automated sequence at least on condition that the monitoring/control unit 9 has determined that the lifting device 4 is in single reeving configuration;
- the second automated sequence at least on condition that the monitoring/control unit 9 has determined that the lifting device 4 is in double reeving configuration.

The monitoring/control unit 9 can also be connected to an unwinding sensor provided on the lifting winch 47 and capable of measuring an unwound length of the lifting cable 40. Thus, the monitoring/control unit 9 can compare the unwound lengths of the lifting cable 40 at the beginning of a first automated sequence and at the beginning of a second automated sequence which follows or precedes this first automated sequence, and the monitoring/control unit 9 can thus automatically determine the reeving configuration also depending on this comparison between the unwound lengths of the lifting cable 40.

If these unwound lengths of the lifting cable 40 are not equivalent, then the monitoring/control unit 9 establishes the presence of an error and automatically restarts the current sequence and/or emits an alarm.

Thus, during a first automated sequence, the monitoring/control unit 9 supervises the proper conduct as follows:

- the monitoring/control unit 9 checks, before launching the first sequence, that the lifting device 4 is in the single reeving configuration (for example by detecting the presence of the remaining trolley 6 at the storage location);
- checking that the unwound length of the lifting cable 40 is equivalent to the unwound length of the lifting cable 40 memorized during the preceding reeving change;
- the monitoring/control unit 9 launches the first sequence by driving the displacement of the distributing trolley 5 and the displacement of the lifting cable 40;
- the monitoring/control unit 9 checks that the lifting device 4 has passed to the double reeving configuration (for example by detecting the absence of the remaining trolley 6 at the storage location).

At the end of these steps, the monitoring/control unit 9 confirms that the reeving configuration is the double reeving configuration if no error has been detected, and memorizes this double reeving configuration in the storage module 90.

Likewise, during a second automated sequence, the monitoring/control unit 9 supervises the proper conduct as follows:

- the monitoring/control unit 9 checks, before launching the second sequence, that the lifting device 4 is in the double reeving configuration (for example by detecting the absence of the remaining trolley 6 at the storage location);
- checking that the unwound length of the lifting cable 40 is equivalent to the unwound length of the lifting cable 40 memorized during the preceding reeving change;
- the monitoring/control unit 9 launches the second sequence by driving the displacement of the distributing trolley 5 and the displacement of the lifting cable 40;
- the monitoring/control unit 9 checks that the lifting device 4 has passed to the single reeving configuration (for example by detecting the presence of the remaining trolley 6 at the storage location).

At the end of these steps, the monitoring/control unit 9 confirms that the reeving configuration is the single reeving configuration if no error has been detected, and memorizes this single reeving configuration in the storage module 90.

With reference to FIGS. 5 and 6, the lifting crane 1 may also comprise a load sensor 91 coupled to a lifting strand of the lifting cable 90 in order to measure a lifting tension on that lifting strand.

In this case, the monitoring/control unit 9 is connected to this load sensor 91 and is designed to calculate a value of the load depending on the lifting tension measured on this lifting strand and on the reeving configuration which is automatically determined by the monitoring/control unit 9, insofar as a single reeving configuration corresponds to a distribution of the load on two lifting strands, and a double reeving configuration corresponds to a distribution of the load on four lifting strands.

Thus, the monitoring/control unit 9 can compare the value of the load with a maximum authorized load, and consequently the monitoring/control unit 9 can act on the displacement of the distributing trolley 5 and the displacement of the lifting cable 40 if the maximum authorized load is exceeded, and can in particular stop any displacement of the load if the maximum authorized load is exceeded.

The system for automated determination of the reeving, and/or components thereof, may be implemented as, or include, one or more computers having a processor and a non-transitory computer-readable storage medium operably connected to the processor. The one or more computers may also include a communication module configured to facilitate communication (i.e., to transmit and/or receive information) with other components of the system for automated determination of the reeving and/or of the lifting crane. The processor may be a microprocessor. The processor is configured to execute program instructions stored in the computer-readable storage medium to control operations of the lifting crane, or components of the lifting crane, according to the program instructions. In this manner, the methods, steps, operations, processes and the like of the system for automated determination of the reeving, or components thereof, such as the monitoring/control unit and/or the system for detecting the presence of the secondary block, as described above, may be performed by way of the one or more computers.

The invention claimed is:

1. A lifting crane comprising:

a jib;

a lifting device with double reeving configured to distribute and lift a load along the jib, wherein the lifting device is reversibly configurable between two reeving configurations including a single reeving configuration with two lifting strands and a double reeving configuration with four lifting strands, the lifting device comprising a reeving change system for performing a reeving change between the single reeving configuration and the double reeving configuration, and vice versa; and a system for automated determination of the reeving configured to automatically determine the reeving configuration between the single reeving configuration and the double reeving configuration, wherein the lifting device further comprises a distributing trolley comprising a structure suspended on the jib and connected to a distribution system configured for displacing the distributing trolley along the jib in a forward direction and a rearward direction which are opposite to each other, and a main block suspended from the suspended structure by a lifting cable, wherein the reeving change system comprises a secondary block and a locking/unlocking mechanism cooperating with the main block and the secondary block to pass from the single reeving configuration to the double reeving configuration or vice versa, and wherein the system for automated determination of the reeving comprises at least:

a system for detecting the presence of the secondary block configured to detect a presence and/or absence of the secondary block at a predetermined reference location occupied by the secondary block in either of the reeving configurations; and a monitoring/control unit connected to the system for detecting the presence of the secondary block and configured to automatically determine the reeving configuration depending on the detection of the absence and/or presence of the secondary block at the reference location, wherein the reeving change system passes the lifting device from the single reeving configuration to the double reeving configuration, and vice versa, by displacing the distributing trolley with the main block thereof, and the monitoring/control unit is connected to the distribution system to drive the displacement of the distributing trolley according to:

a first automated sequence passing the lifting device from the single reeving configuration to the double reeving configuration, and vice versa; and a second automated sequence passing the lifting device from the double reeving configuration to the single reeving configuration, depending on the reeving configuration which is automatically determined by the monitoring/control unit, and wherein the lifting crane further comprises a lifting winch provided with a lifting drum cooperating with the lifting cable to displace the load upward and downward, the lifting winch equipped with an unwinding sensor for measuring an unwound length of the lifting cable, wherein the monitoring/control unit is configured to compare the unwound lengths of the lifting cable at the beginning of the first automated sequence and at the beginning of the second automated sequence which follows or precedes the first automated sequence.

2. The lifting crane according to claim 1, wherein:

the system for automated determination of the reeving comprises a storage module connected to the monitoring/control unit for storing at least one last reeving configuration determined by the monitoring/control unit, and the monitoring/control unit is configured to automatically determine the reeving configuration also depending on the last reeving configuration stored in the storage module.

3. The lifting crane according to claim 1, wherein:

in the single reeving configuration, the locking/unlocking mechanism unlocks the secondary block which remains positioned inside a block housing provided on the main block such that the lifting cable cooperates with the main block for a two-strand lifting, and in the double reeving configuration, the locking/unlocking mechanism locks the secondary block on the distributing trolley at a location above the main block such that the lifting cable cooperates with both the main block and the secondary block for a four-strand lifting.

4. The lifting crane according to claim 3, wherein the system for detecting the presence of the secondary block is configured to detect the presence and/or absence of the secondary block inside the block housing occupied by the secondary block in the single reeving configuration and/or at the location above the main block occupied by the secondary block in the double reeving configuration.

5. The lifting crane according to claim 3, wherein:

the reeving change system comprises a remaining trolley comprising a frame suspended on the jib and supporting the secondary block, wherein:

in the double reeving configuration, the locking/unlocking mechanism locks together the distributing trolley and the remaining trolley which are assembled and displaceable in association along the jib, and the secondary block is suspended on the remaining trolley at the location above the main block, and in the single reeving configuration, the locking/unlocking mechanism unlocks the remaining trolley, such that the distributing trolley and the remaining trolley are disassembled, the secondary block is housed inside the block housing provided on the main block and the distributing trolley is displaceable on its own while the remaining trolley is statically positioned with the secondary block at a storage location, and the system for detecting the presence of the secondary block is configured to detect a presence and/or absence of the remaining trolley at the storage location.

6. The lifting crane according to claim 1, wherein the monitoring/control unit is configured to enable:

the first automated sequence at least on condition that the monitoring/control unit has determined that the lifting device is in single reeving configuration; and the second automated sequence at least on condition that the monitoring/control unit has determined that the lifting device is in double reeving configuration.

7. The lifting crane according to claim 1, wherein the monitoring/control unit is configured to automatically determine the reeving configuration also depending on the comparison between the unwound lengths of the lifting cable at the beginning of the first automated sequence and at the beginning of the second automated sequence which follows or precedes the first automated sequence.

8. The lifting crane according to claim 1, comprising a load sensor coupled to a lifting strand of the lifting cable for measuring a lifting tension on the lifting strand, wherein the monitoring/control unit is connected to the load sensor and is configured to calculate a value of the load depending on the lifting tension on the lifting strand and on the reeving configuration which is automatically determined by the monitoring/control unit.

9. The lifting crane according to claim 8, wherein the monitoring/control unit is configured to compare the value of the load with a maximum authorized load.

10. A driving method for driving a lifting crane, the lifting crane comprising:

a jib;

a lifting device with double reeving configured to distribute and lift a load along the jib, wherein the lifting device is reversibly configurable between two reeving configurations including a single reeving configuration with two lifting strands and a double reeving configuration with four lifting strands, the lifting device comprising a reeving change system for performing a reeving change between the single reeving configuration and the double reeving configuration, and vice versa; and a system for automated determination of the reeving configured to automatically determine the reeving configuration between the single reeving configuration and the double reeving configuration, the driving method comprising the steps of:

performing a reeving change between the single reeving configuration and the double reeving configuration, or vice versa; and automatically determining the reeving configuration between the single reeving configuration and the double reeving configuration, wherein the lifting device comprises a distributing trolley comprising a structure suspended on the jib and connected to a distribution system configured for displacing the distributing trolley along the jib in a forward direction and a rearward direction which are opposite to each other, and a main block suspended from the suspended structure by a lifting cable, wherein the reeving change system comprises a secondary block and a locking/unlocking mechanism cooperating with the main block and the secondary block to pass from the single reeving configuration to the double reeving configuration or vice versa, and wherein the system for automated determination of the reeving comprises at least:

a system for detecting the presence of the secondary block configured to detect a presence and/or absence of the secondary block at a predetermined reference location occupied by the secondary block in either of the reeving configurations; and a monitoring/control unit connected to the system for detecting the presence of the secondary block and configured to automatically determine the reeving configuration depending on the detection of the absence and/or presence of the secondary block at the reference location, wherein the driving method further comprises the steps of:

detecting a presence and/or absence of the secondary block at a predetermined reference location occupied by the secondary block in either of the reeving configurations;

automatically determining the reeving configuration depending on the detection of the absence and/or presence of the secondary block at the reference location;

driving the displacement of the distributing trolley according to:

a first automated sequence passing the lifting device from the single reeving configuration to the double reeving configuration, and vice versa; and a second automated sequence passing the lifting device from the double reeving configuration to the single reeving configuration, depending on the automatically determined reeving configuration, measuring an unwound length of the lifting cable, the lifting cable cooperating with a lifting drum of a lifting winch to displace the load upward and downward; and comparing the unwound lengths of the lifting cable at the beginning of the first automated sequence and at the beginning of the second automated sequence which follows or precedes the first automated sequence.

11. The driving method according to claim 10, comprising a step of storing at least one last automatically determined reeving configuration, and wherein the configuration of the lifting device is automatically determined also depending on the last stored reeving configuration.

12. The driving method according to claim 10, comprising the step of enabling:

the first automated sequence at least on condition that it is automatically determined that the lifting device is in single reeving configuration, and the second automated sequence at least on condition that it is automatically determined that the lifting device is in double reeving configuration.

13. The driving method according to claim 10, wherein the configuration of the lifting device is automatically determined also depending on the comparison between the unwound lengths of the lifting cable at the beginning of the first automated sequence and at the beginning of the second automated sequence which follows or precedes the first automated sequence.

14. The driving method according to claim 10, further comprising the steps of:

measuring a lifting tension on a strand of the lifting cable; and calculating a value of the load depending on the lifting tension on the strand of the lifting cable and on the automatically determined reeving configuration.

15. The driving method according to claim 14, further comprising the step of comparing the value of the load with a maximum authorized load.

* * * * *